United States Patent [19]

Runyon

[11] 4,219,004

[45] Aug. 26, 1980

[54] FLEXIBLE, SELF-SUPPORTING BLADE FOR CUTTING ELECTRONIC CRYSTALS AND SUBSTRATES OR THE LIKE

[75] Inventor: Robert C. Runyon, St. Louis County, Mo.

[73] Assignee: Chemet Research, Inc., Addison, Tex.

[21] Appl. No.: 961,946

[22] Filed: Nov. 20, 1978

Related U.S. Application Data

[62] Division of Ser. No. 825,587, Aug. 18, 1977, abandoned.

[51] Int. Cl.[3] ..... B28D 1/04

[52] U.S. Cl. ..... 125/15; 427/383.7

[58] Field of Search ..... 125/15; 51/206 R; 427/383 C

[56] References Cited

U.S. PATENT DOCUMENTS

| | | | |
|---|---|---|---|
| Re. 29,285 | 6/1977 | Christini | 428/426 |
| 3,353,306 | 11/1967 | Seymour | 51/206 R |
| 3,488,892 | 1/1970 | Benner | 125/15 X |
| 3,617,363 | 11/1971 | Metzger | 427/383 C |
| 3,691,707 | 9/1972 | Von Arx | 125/15 X |
| 3,785,938 | 1/1974 | Sam | 204/16 |
| 3,886,925 | 6/1975 | Regan | 125/15 |

FOREIGN PATENT DOCUMENTS

| | | |
|---|---|---|
| 804376 | 11/1958 | United Kingdom . |
| 908928 | 10/1962 | United Kingdom . |
| 953506 | 3/1964 | United Kingdom . |
| 1350758 | 4/1974 | United Kingdom . |

OTHER PUBLICATIONS

Brochure, "Disco Abrasive System", Dia-Ichi Seitosho Ltd., dated Dec. 5, 1974.

Brochure, Electroglas Inc., dated 5-1974.

*Primary Examiner*—Harold D. Whitehead

*Attorney, Agent, or Firm*—Kenyon & Kenyon

[57] ABSTRACT

A diamond-nickel blade for cutting electronic crystals and substrates or the like comprising diamond particles in a nickel matrix. The nickel matrix is the sole support for the blade and the volume of the nickel matrix is no greater than about 55% of the volume of the blade. Such blades are made by immersing a flat, electrically conductive substrate in a suspension comprising diamond particles in an electrolyte; electrodepositing nickel in an annular pattern corresponding to the desired shape of the blade on a surface of the substrate, the electrodeposited nickel being only lightly adherent to the substrate surface (diamond particles are thereby codeposited in the nickel which forms a matrix around them); and stripping the annular deposit of nickel and diamond particles from the substrate. Also disclosed are blade-mounting means comprising two identical, lapped-surface collars and a ring.

18 Claims, 12 Drawing Figures

FLEXIBLE, SELF-SUPPORTING BLADE FOR CUTTING ELECTRONIC CRYSTALS AND SUBSTRATES OR THE LIKE

This is a division of application Ser. No. 825,587 filed Aug. 18, 1977 and now abandoned.

BACKGROUND OF THE INVENTION

This invention relates to blades for cutting electronic crystals and substrates or the like and more particularly to such blades which are flexible and self-supporting.

Blades for cutting electronic crystals and substrates or the like are used extensively in the semiconductor industry. Such electronic crystals and substrates include germanium, gallium arsenide, silicon, quartz, aluminum oxide, beryllium oxide, sapphire, glass and others. Using silicon as an example, a silicon crystal is first sliced into wafers by a large slicing saw. A large number of semiconductor devices are then photofabricated onto each wafer. Cutting or dicing blades are then used to dice the wafer to separate the semiconductor devices, or chips, fabricated thereon.

Existing cutting blades, however, are not without disadvantages. Some dicing blades, for example, consist of a plating of nickel and diamond on an aluminum hub support, the volume of the nickel being greater than 80% of the volume of the plating. These blades are difficult and expensive to make. The nickel is plated in the shape of a narrow ring near the outer margin of the aluminum hub. Subsequently a peripheral portion of the hub is etched away to expose a narrow rim of the nickel-diamond cutting surface. The aluminum hub support for these blades must be machined to very small tolerances, usually 0.0001" (0.00025 cm). But the expense of this machining is wasted if the nickel-diamond plating on the hub is defective. Likewise the hub must be discarded if the cutting surface created by etching back the hub is too large, too small, or otherwise defective. The etching process is very inexact, resulting in a large parts-failure rate. On the other hand, if a satisfactory nickel-diamond cutting surface is formed on a hub, but the hub is for some reason defective, e.g., improperly machined, again the entire hub-cutting surface combination must be discarded. Thus, the cost of these blades is high. An additional disadvantage of these blades is that they are not reuseable: once the cutting portion of the blade has worn down, the blade must be thrown away. Finally, because the width of the hub and the diameter of the nickel-diamond cutting surfaces vary from blade to blade, the dicing saw must be realigned each time a new blade is put on the saw.

Other metal-diamond dicing blades are made by pressing diamond particles into a thin sheet of metal. The diamond particles, however, only enter the exterior of the metal sheet and therefore do not uniformly disperse throughout the metal sheet. As a result, the flat sides of these blades have a substantial concentration of diamond particles, but the cutting edge or rim of the blade has a much lower concentration.

Copper-diamond and bronze-diamond dicing blades are formed by sintering. These sintered blades, however, cannot be made thinner than about three mils, which generates a cut or kerf wider than desired. Such blades tend to warp during the sintering process, especially blades as thin as three mils, so thin sintered blades are an expensive, limited-production, special-order item.

Dicing blades are also made of diamond powder bonded in a phenolic resin. These phenolic blades wear faster and are more fragile than the diamond-nickel blades.

No matter what type of dicing blade is used, an overriding problem is getting the cutting surface of the blade perpendicular to the crystal or substrate being cut. Cutting at any angle other than 90° results in a cut which is too wide, thereby wasting valuable material.

Prior art dicing wheels are described in "Dicing Wheels for Wafer Separation," *Electronic Packaging & Production,* July, 1977, Vol. 17, p. 196.

SUMMARY OF THE INVENTION

Among the several objects of this invention may be noted the provision of a cutting blade which is relatively simple and inexpensive to make, which is self-supporting, which can cut crystals and substrates of a wide range of thicknesses, which has less nickel content than existing cutting blades, which is ductile enough to resist mechanical stress, which is sufficiently thin, which has greater wear resistance, and which does not necessitate realignment of the dicing saw for each new blade used; the provision of a method for conveniently and economically fabricating such cutting blades; and the provision of a means for mounting such cutting blades so that the blade itself is as perpendicular as possible to the surface of the crystal or substrate being cut.

Briefly, a blade of this invention is flexible and self-supporting and comprises diamond particles in a nickel matrix, the nickel matrix constituting the sole support for the diamond particles. Preferably, the blade comprises diamond particles in a matrix consisting essentially of nickel, the volume of which matrix is no greater than about 55% of the volume of the blade.

In brief, a blade of this invention is made by immersing a flat, electrically conductive substrate in a suspension comprising diamond particles in an electrolyte; and electrodepositing nickel in an annular pattern corresponding to the desired shape of the blade on a surface of the substrate to which the electrodeposited nickel is only lightly adherent. The annular deposit of nickel and diamond particles is then stripped from the substrate to form a flexible, self-supporting blade for cutting electronic crystals, substrates and the like.

The invention also includes blade-mounting means comprising a pair of generally flat round collars each having a round central opening to be received on the spindle of a dicing saw of a diameter somewhat less than that of the central aperture of the blade to be mounted thereby. Each collar has lapped parallel opposite surfaces in planes perpendicular to the axis of the opening and a circular recess in one of its surfaces centered on its axis. The collars are adapted to be mounted on the spindle with the recesses facing one another. Each recess has a diameter corresponding to the diameter of the aperture of the blade. The ring has a width less than the sum of twice the depth of the recess and the thickness of the blade but substantially greater than the thickness of the blade. The width of the ring is great enough to be received in both of the recesses when the collars are assembled with the recesses thereof opposing each other with a blade interposed therebetween. When so assembled on the spindle, clamping pressure may be applied to the blade by the collars and the blade may be coaxially secured to the spindle with its plane precisely perpendicular to the axis of the spindle.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
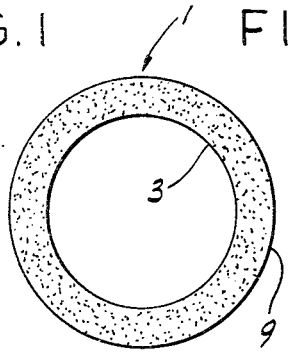
FIG. 1 is a front elevation of a flexible, self-supporting blade of this invention.

Referring now to the drawings, a cutting blade of the present invention is indicated generally at 1. Blade 1 is an annular blade having a central aperture 3 and a cutting edge 9. A wide variation in the dimensions of blade 1 is permissible. Typically, however, dicing blades are around 2-3/16" (5.5 cm) in diameter, so a blade of that size will be used herein for purposes of illustration. The width of blade 1 is not critical. For a 2-3/16" (5.5 cm) blade, a width of 5/16" (0.794 cm) is a satisfactory dimension. The thickness of blade 1 may be as little as around 0.6 mil (0.0015 cm) or as much as six mils (0.015 cm) or more. It is preferable, however, to make the thickness of blade 1 about 3 mils (0.0075 cm) or less in order to reduce the width of the cut made by the blade.

Figure 3:
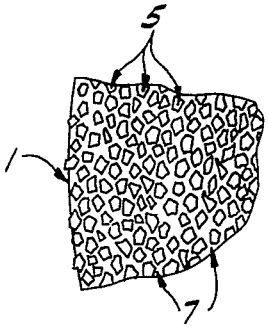
FIG. 3 is an exaggerated, microscopic elevation of a portion of the blade shown in FIG. 1.

As shown in FIG. 3, blade 1 is composed of a plurality of particles 5 in a matrix 7 of nickel. The term "nickel" as used herein includes nickel alloys with minor constituents, especially 1–3% cobalt, which do not substantially affect the properties of the matrix. It is preferred that matrix 7 consist essentially of nickel. Particles 5 can be all natural diamond particles or a mixture of diamond particles and other particles having a specific gravity substantially that of diamond, such as particles of alumina. The diamond particles act as the principal cutting elements of blade 1. The addition of alumina particles to matrix 7 results in somewhat faster blade wear than is the case where all particles 5 are diamond. Some blade wear is, of course, desirable since blade wear causes new diamond cutting elements to continually become exposed on cutting edge 9 of blade 1. Also, without blade wear, silicon, for example, can load up a dicing blade during dicing so much that the cutting characteristics of the blade are changed. The respective amounts of alumina and diamond particles can, of course, be varied to achieve desired blade wear and cutting rates. Approximately equal percentages by weight of alumina and diamond particles result in a blade 1 having desirable cutting characteristics. As noted above, the percentage of alumina may also be made less than that of diamond to decrease the wear rate of blade 1, thereby increasing blade life somewhat, or may be somewhat greater than that of diamond.

As indicated in FIG. 3, the volume of nickel matrix 7 is no greater than about 55% of the total volume of blade 1. It has been found that a nickel matrix volume of 55% of blade 1 volume, irrespective of whether particles 5 are solely diamond particles or both diamond and alumina particles, results in a blade with excellent cutting characteristics.

Figure 2:
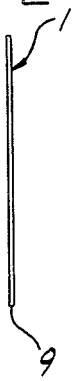
FIG. 2 is a side elevation of FIG. 1.

Blade 1 as described above is a nickel-diamond blade which is quite flexible and can be bent double without breaking. Normally, the blade must be creased before it will break. It is self-supporting or free-standing, as shown in FIGS. 1 and 2, since it is a physicially separate, distinct blade, not plated or attached to any support. That is, the sole support for blade 1 is nickel matrix 7.

The size of diamond particles 5 in blade 1 can be varied up to thirty microns or higher. It is preferred that the diamond particles be about 6–8 microns in size as graded by the U.S. Bureau of Standards, i.e., no more than 5% of the particles are smaller than 6–8 microns and no more than 5% are larger. The 6–8 micron natural diamond particles sold by Baumgold Industrial Diamond of New York, N.Y. result in an excellent blade. Likewise alumina particles 5 are varied in size corresponding to the diamond particle size. It is preferred that the alumina particles for a blade with 6–8 micron diamond particles be substantially between 6 microns and 9 microns in size, such as those 6–9 micron alumina powders sold under the trade designation "Microgrit" by the Microabrasives Corporation of Westfield, Mass.

Figure 4:
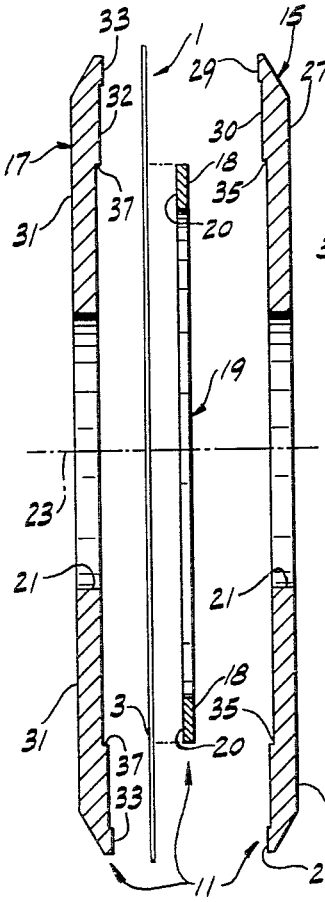
FIG. 4 is an exploded sectional view, on a larger scale, of the blade as shown in FIG. 2 and one embodiment of the mounting means of this invention.
Figure 5:
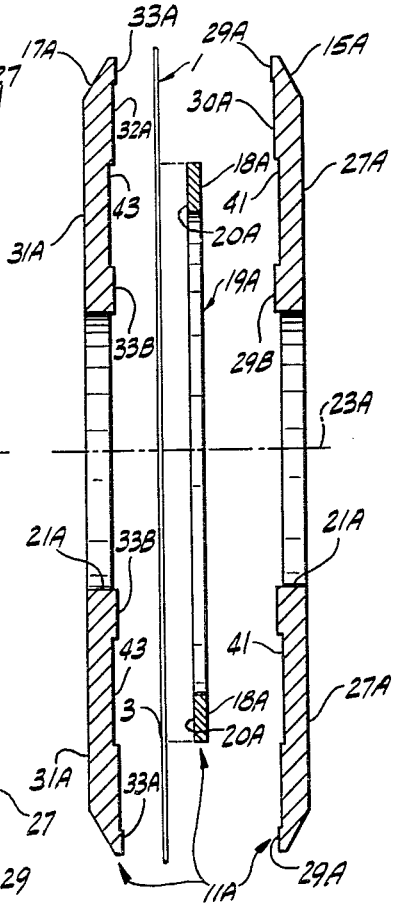
FIG. 5 is an exploded sectional view, on a larger scale, of the blade as shown in FIG. 2 and another embodiment of the mounting means of this invention.

Blade 1 can be used in a dicing saw for cutting all semiconductor substrates and crystals, including but not limited to germanium, gallium arsenide, silicon, quartz, aluminum oxide, beryllium oxide, sapphire and glass. In order to use blade 1 in a dicing saw it is necessary to mount it in a mounting means, such as the mounting means of FIGS. 4 and 5 designated generally by reference numerals 11 and 11A. The constituent parts of mounting means 11 are right collar 15, left collar 17 and centering ring 19. Right collar 15 and left collar 17 are generally flat, round collars having central round openings 21, shown in section in FIG. 4, centered on axis 23 to be received on a dicing saw spindle, indicated by dashed lines 25 in FIG. 6. Note that in FIGS. 4 and 5 the background lines have been omitted for clarity. The diameter of openings 21, as can be seen from FIG. 4, is somewhat less than the diameter of blade aperture 3.

Collar 15 has opposite surfaces 27 and 29 which are lapped parallel to each other, within one-tenth of a mil (0.00025 cm) and are perpendicular to axis 23. Likewise collar 17 has opposite surfaces 31 and 33 which are lapped parallel to each other and are perpendicular to axis 23. It is necessary to lap surfaces 27,29 and 31,33; only by lapping can the surfaces be made sufficiently parallel to hold blade 1 precisely perpendicular to the axis of spindle 25.

Note that surfaces 29 and 33 are annular-shaped portions at the margins of their respective collars. These annular marginal portions support blade 1 solely adjacent its edge so as to reduce wobble of blade 1 to a minimum. Recesses 30 and 32 also insure that marginal portions 29 and 33 only engage blade 1 near its edge. If recesses 30 and 32 were not present, blade 1 could be engaged by collars 15 and 17 on a circle having a diameter much less than the inner diameter of annular marginal portions 29 and 33, thereby considerably reducing support for blade 1. Collar 15 has a circular recess 35 centered on axis 23 in a surface opposite lapped surface 27. Likewise collar 17 has a circular recess 37 centered on axis 23 in a surface opposite lapped surface 31. As shown in FIG. 4, collars 15 and 17 are adapted to be mounted on spindle 25 with recesses 35 and 37 facing one another. Recesses 35 and 37 have diameters corresponding to the diameter of blade aperture 3. For reasons discussed below, however, the diameter of recess 37 is preferably slightly larger than that of recess 35.

Ring 19 is used to center blade 1 in mounting means 11 so as to provide a uniform amount of exposed blade exterior to the mounting means when means 11 and blade 1 are secured together on spindle 25. Centering ring 19 has two essentially parallel surfaces 18 and 20 and an outer diameter corresponding to that of recesses 35 and 37 and to the diameter of blade aperture 3. The outer diameter of ring 19 should be just slightly less, for example, 0.001" (0.0025 cm), than the diameter of blade aperture 3 so that blade 1 can be slipped over ring 19 but without significant play. The width of ring 19, i.e., that dimension of ring 19 between surfaces 18 and 20, is such that it fits within recesses 35 and 37 when mounting means 11 is assembled around blade 1, and is constrained by collars 15 and 17 from moving out of either recess. That is, ring 19 has a width less than the sum of the depths of recesses 35 and 37 and the width of blade 1, but great enough to be received in both recess 35 and recess 37 when collars 15 and 17 are assembled with the recesses facing one another with blade 1 interposed therebetween. Of course, the width of ring 19 is also substantially greater than the thickness of blade 1.

Figure 6:
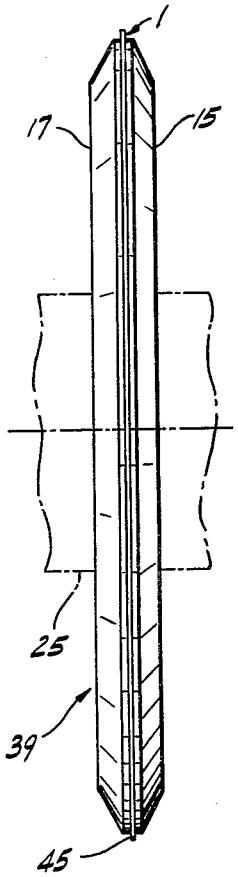
FIG. 6 is a side elevation of the blade of this invention mounted in a blade-mounting means of this invention.

Blade 1 may be mounted in mounting means 11 as follows to form a blade assembly, such as that indicated generally by reference numeral 39 on FIG. 6. Blade 1 is first slipped onto centering ring 19. Ring 19 can then be laid in recess 35 which effectively centers blade 1 with respect to collar 15. If recess 37 is slightly larger than recess 35, collar 17 can then be easily laid over ring 19. If recess 37 is only about 0.002" (0.005 cm) larger than recess 25, there will be very little play between ring 19 and collar 17 and as a result blade 1 will also be centered with respect to collar 17.

When blade assembly 39 is tightened down on spindle 25 by a nut (not shown), for example, collars 15 and 17 exert clamping pressure on blade 1. The result is that blade 1 is coaxially secured to spindle 25 and, because of the geometry of lapped surfaces 27, 29, 31 and 33, the plane of blade 1 is precisely perpendicular to the axis of the spindle which is congruent with axis 23.

Mounting means 11A is an alternative embodiment of mounting means 11. Mounting means 11A differs from mounting means 11 in only two respects: (1) mounting means 11A has circular grooves 41 and 43 and annular central portions 29B and 33B instead of recesses 35 and 37; (2) the interior surfaces of mounting means 11A have greater lapped areas than those of surfaces 29 and 33 of mounting means 11. Parts of mounting means 11A corresponding to mounting means 11 are designated by the letter A after the reference numeral. For example, mounting means 11A has right and left collars 15A and 17A corresponding to collars 15 and 17 of mounting means 11.

Grooves 41 and 43 are centered on axis 23A and have outer diameters corresponding to the diameter of blade aperture 3. The inner diameters of grooves 41 and 43, and thus the outer diameters of annular central portions 29B and 33B, are at least as small as the inner diameter of ring 19, or conversely, ring 19 has an inner diameter at least as large as that of grooves 41 and 43. Similarly the depth of grooves 41 and 43 is such that the width of ring 19 is less than the sum of the depths of grooves 41 and 43 (or, which is the same thing, twice the depth of either groove) and the thickness of blade 1. Likewise ring 19 is received in both groove 41 and groove 43 when collars 15A and 17A are assembled.

The interior lapped surfaces of mounting means 11A include annular portions 29B and 33B adjacent central opening 21A which are not present in mounting means 11. These additional lapped portions have a dual function. First, they avoid any tendency for collars 15A and 17A to bow when blade assembly 39 is tightened tightly on spindle 25, thereby keeping blade 1 truly perpendicular to axis 23A (and thus to the plane of the crystal or substrate being cut) and preventing undue wobble of the blade. Second, portions 29B and 33B, being on the same planes as surfaces 29A and 33A, respectively, increase the area lapped on these inner surfaces, thus making the areas of the opposite surfaces more nearly equal. This in turn further ensures that surfaces 29A and 33A are truly parallel to surfaces 27A and 31A.

Collars 15 and 17 are essentially identical, the only difference being a preferable minor variation in the sizes of recesses 35 and 37. Likewise, collars 15A and 17A are essentially identical, the only difference between them being a corresponding variation in the sizes of grooves 41 and 43.

When mounted on spindle 25 to form blade assembly 39, collars 15 and 17 (or 15A and 17A, since these collars can be used as interchangeable sets) orient blade 1 precisely perpendicular to the axis of spindle 25 because of lapped parallel opposite surfaces 27, 29, 31 and 33. The outer diameter of collars 15 and 17 should be from 0.030" to 0.040" (0.076 to 0.102 cm) less than the diameter of blade 1 for a 2-3/16" (5.5 cm) blade. This means that the exposed surface 45 of blade 1, when a part of blade assembly 39, is between 0.015" (0.038 cm) and 0.020" (0.051 cm). Smaller collars can be used to expose more blade for a deeper cut. But in general, blade exposure is preferably not greater than 20 to 25 times the thickness of the blade. Even more importantly, as blade 1 wears down it need not be thrown away; it can be reused simply by mounting it in a series of collars having incrementally reduced outer diameters.

One advantage of blade assembly 39 might not be readily apparent. Typically blade assembly 39 can be put on a dicing machine and aligned. Thereafter, when blade 1 wears down it can be replaced by a new blade 1, leaving the same collars and ring on the dicing saw. When this is done there is no need to realign the saw; new blade 1 will cut in exactly the same position as old blade 1.

Blade 1 is made by a method illustrated in FIGS. 7–12. Basically, formation of blade 1 is commenced by immersing a flat, electrically conductive substrate, such as an aluminum plate 47, in a suspension of diamond particles in an electrolyte 49. The diamond particles in suspension are the same size as desired in the finished blade. Because of the small size of the diamond particles, they are not shown in the figures. Nickel from a solid, disk-shaped anode 51 is electrodeposited in annular patterns 53, 55, 57 and 59 on the top surface of plate 47. Each annular pattern corresponds to the shape of blade 1. The diamond particles in suspension have meanwhile been settling on plate 47. As the nickel is electrodeposited, diamond particles are thereby codeposited in the nickel which forms a matrix around the particles. Because there is no intermediate layer formed on annular patterns 53, 55, 57 and 59 of the surface of aluminum plate 47, the electrodeposited nickel is only lightly adherent to that surface. Blade 1 can therefore be completed by simply stripping the annular deposits of nickel and diamond particles from plate 47.

Aluminum plate 47 can be made from any aluminum with a smooth, shiny, scratch-free surface. 6061 T6 aluminum, for example, will work if one makes sure the surface is smooth and scratch-free. Defects in the surface, however, will make it difficult, if not impossible, to strip blade 1 from plate 47. Best results are achieved by using lithographic plate aluminum in making plate 47 since lithographic plate aluminum ordinarily has one side which is bare aluminum with a very smooth finish. Any aluminum with a similar surface will work just as well, of course. Preferably plate 47 is about 0.008" (0.02 cm) thick.

To prepare plate 47, a piece of sufficiently smooth aluminum is first cleaned by washing with deionized water. Then the aluminum is further cleaned with a commercial degreaser, such as denatured alcohol. At all times care is taken not to scratch the surface of the aluminum, since scratches make it difficult to strip the part off plate 47 and causes blade 1 to have a weak spot corresponding to the location of the scratch. After cleaning with denatured alcohol, the aluminum is wiped with a lint-free towel. The aluminum is then inspected for scratches.

Next all of aluminum plate 47 is photoresistively masked except annular patterns 53, 55, 57 and 59 and circular areas 63, 65, 67 and 69 which are centered on the axes of the respective annular patterns. This is easily done using a photoresist process such as that sold under the trade designation "Photo Resist Type 3 (KPR 3)" by Eastman Kodak Co. of Rochester, N.Y., which happens to be a negative photoresist process. First, the whole plate is coated front and back with KPR 3 photoresist and baked in an oven at 90° C. for eight minutes. The plate is then exposed on both sides for 1.5 minutes using ultraviolet light. The exposure on the side of plate 47 on which annular pattenrs 53, 55, 57 and 59 will be formed is through an appropriate negative mask. The plate is then developed in KPR 3 developer for 1.5 minutes and then washed under tap water to wash the photoresist off the unexposed areas corresponding to areas 53, 55, 57, 59, 63, 65, 67 and 69 of FIG. 10. Then plate 47 is rinsed in deionized water and returned to the oven for a final minute.

Figure 9:
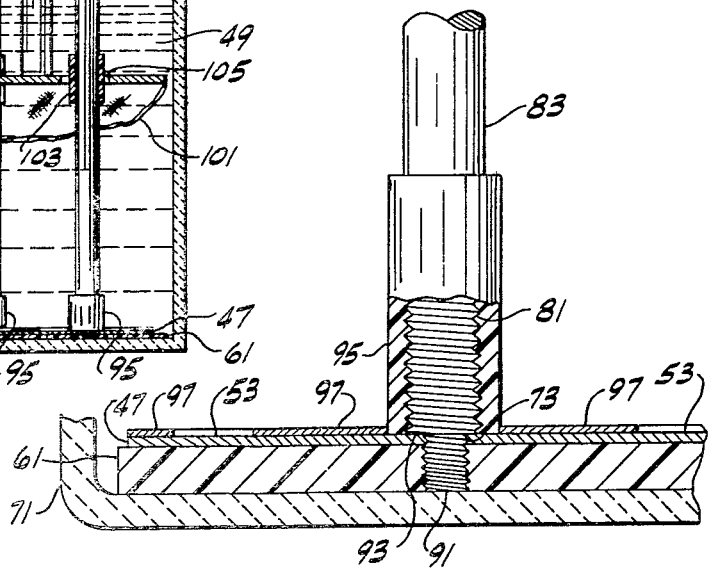
FIG. 9 is an enlarged sectional view of the means of attachment of a titanium rod to an aluminum plate used in the methods of this invention.
Figure 10:
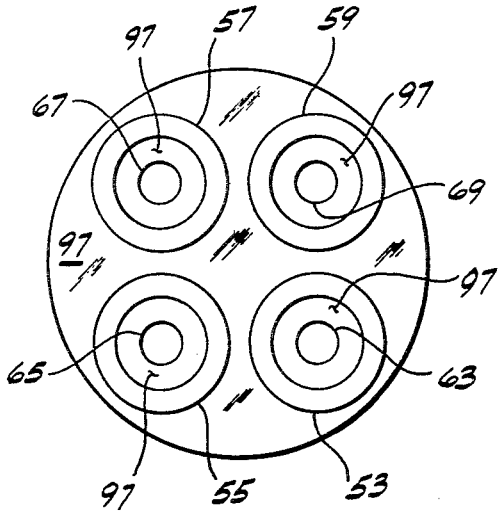
FIG. 10 is a plan view of an aluminum plate as used in a method of this invention.
Figure 11:
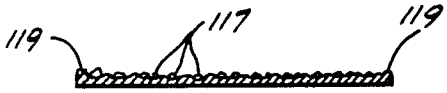
FIG. 11 is an exaggerated microscopic sectional view of the blade shown in FIG. 1.
Figure 12:
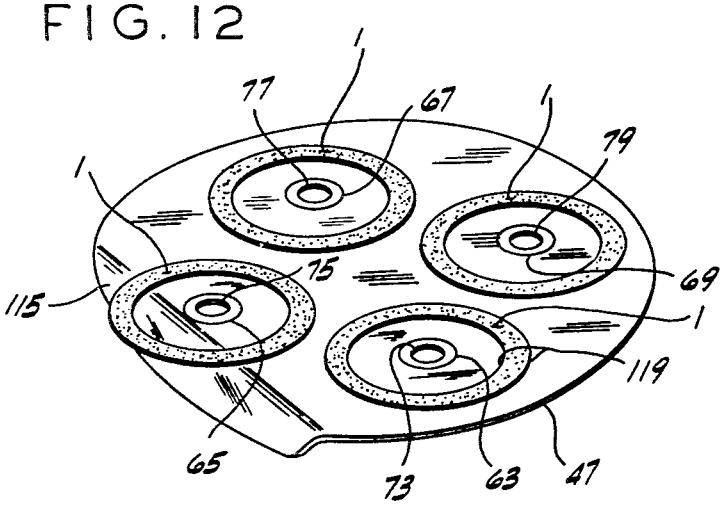
FIG. 12 is a perspective view of a blade, as shown in FIG. 1, being removed from an aluminum plate in accordance with this invention.

Plate 47 is then mounted. Titanium rods 83, 85, 87 and 89 are threaded through plate 47 through holes 73, 75, 77 and 79 drilled in the center of circular areas 63, 65, 67 and 69. The exact mounting method is best seen in FIG. 9. Using rod 83 as an example, rod 83 has a large threaded portion 81 and a reduced threaded portion 91. Large threaded portion 81 could, of course, instead extend the entire length of the rod or have its minor diameter (rather than its major diameter as shown) equal to the diameter of the unthreaded portion of rod 83. Hole 73 in plate 47 has the same diameter as the minor diameter of small threaded portion 91. Reduced threaded portion 91 is threaded through plate 47 into threaded nylon plate 61 which rests on the bottom interior surface of glass beaker 71. Reduced threaded portion 91 is screwed all the way into plate 47 so that base 93 of large threaded portion 81 abuts the bare aluminum surface of area 63 of plate 47. The layer of photoresist, indicated by reference numeral 97, defines both annular pattern 53 and circular area 63. When connected to a source of electrical energy such as a constant-current power supply 109, electrical contact is therefore made between rod 83 and plate 47 by base 93 and reduced threaded portion 91. A one- to two-inch long polyvinylchloride (PVC) spacer 95 is then threaded onto large threaded portion 81.

After plate 47 is mounted, it is again degreased and cleaned. Plate 47 is then put into electrolyte 49 in glass beaker 71. As plate 47 is put into electrolyte 49 it is spun and swirled gently to prevent bubbles from forming on its surface. Note that at this point anode 51 has not yet been placed over rods 83, 85, 87 and 89 and no wires have yet been attached to said rods.

Electrolyte 49 is a nickel sulfamate plating solution having a pH between about 3.1 and about 4.3. Excellent results are obtained by using such an electrolyte as sold under the trade designation "Sulfamex Nickel Plating Solution" by Sel-Rex Company of Nutley, N.J., but other commercial nickel sulfamate solutions, including nickel sulfate/nickel chloride plating baths, are useful for this purpose as well. This bath has the following composition:

Nickel (as metal): 8–16 oz./gal. of bath
Nickel sulfamate: 40–70 oz./gal.
Boric acid: 3–5 oz./gal.
Anode activator: 6–14 fl. oz./gal.

The anode activator is typically nickel chloride. Adding an additional five ounces of nickel chloride per gallon of bath does not affect the characteristics of a blade made therein. The amount of boric acid is adjusted to maintain the pH in the range indicated above. A wetting agent (such as that sold under the trade designation "Ivory Liquid" by Procter & Gamble, or other mild detergent) is added before electrodeposition. The amount of wetting agent added is preferably between 0.5 gm and 1.0 g per liter of bath. The bath is kept at a temperature between about 47° C. and about 57° C. This is easily accomplished by preheating beaker 71 containing electrolyte 49 on a hot plate and then putting the beaker in a temperature-control tank 98 containing a solution 99 of ethylene glycol which is at a temperature about 5° C. higher than the desired bath temperature. A bath temperature of 52°–53° C. and an ethylene glycol temperature of about 58° C. give excellent results.

Diamond particles of the desired size are added to the bath before plating. Using 100 to 150 carats of diamond powder per 2.5 liters of electrolyte or plating solution 49 results in a blade having three to four times the number of diamond particles as prior art blades. The number of diamond particles in the finished blade can, of course, be reduced by reducing the amount of diamond powder added to the solution. It is advantageous to add alumina, or other particles having a specific gravity approximately the same as diamond, to electrolyte bath 49 in place of some of the diamond powder. The alumina particles are codeposited along with the diamond particles into nickel matrix 7, forming a blade 1 with a greater wear rate. The advantages of this are discussed above. Excellent blades are made by putting equal weights of alumina and diamond powder into electrolyte 49. Harder blades may, of course, be made by reducing the amount of alumina put into electrolyte 49.

After plate 47 is placed in beaker 71, anode 51 is placed over rods 83, 85, 87 and 89 and let down into electrolyte 49. Anode 51 has attached thereto standard anode bag 101 to catch impurities such as carbon particles, which fall from the anode during electrodeposition. It is to be understood that although anode 51 is shown as a solid nickel disk, titanium anode baskets containing pieces of nickel can also be used. The surface area of whatever anode is used is, however, preferably at least three times the surface area of the exposed portion of aluminum plate 47, i.e., the area of annular patterns 53, 55, 57 and 59. Of course, the higher this ratio, the better. Use of titanium anode baskets gives a sufficient ratio and reduces contamination of blade 1 by the impurities mentioned above.

Figure 7:
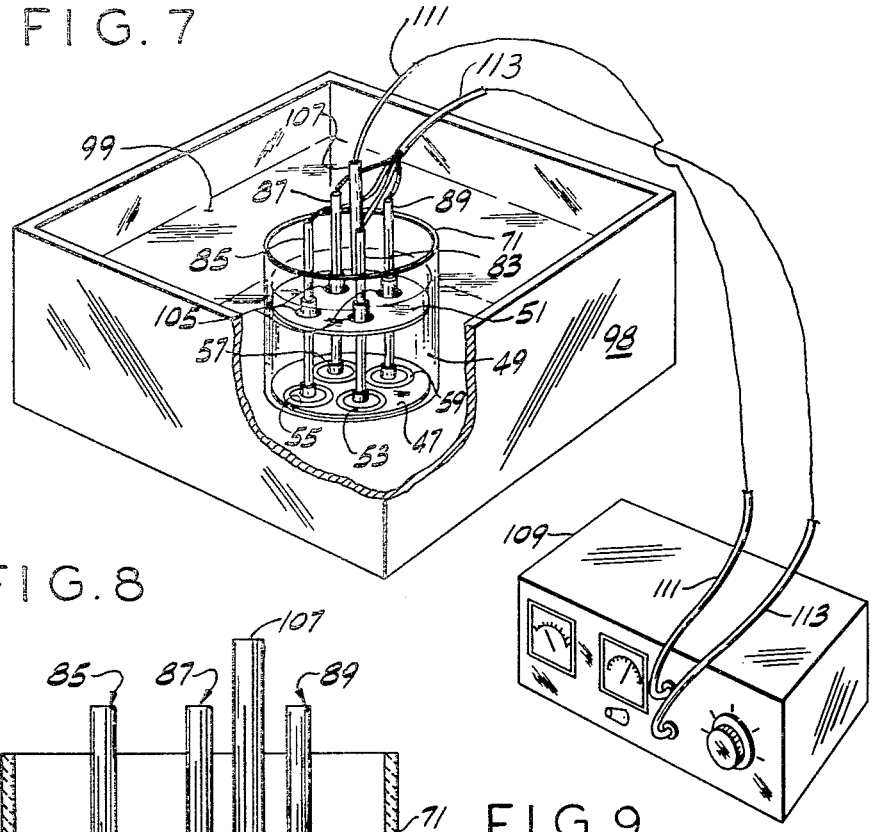
FIG. 7 is a perspective view of apparatus (with a portion of the temperature control tank broken away) for making blades of this invention.
Figure 8:
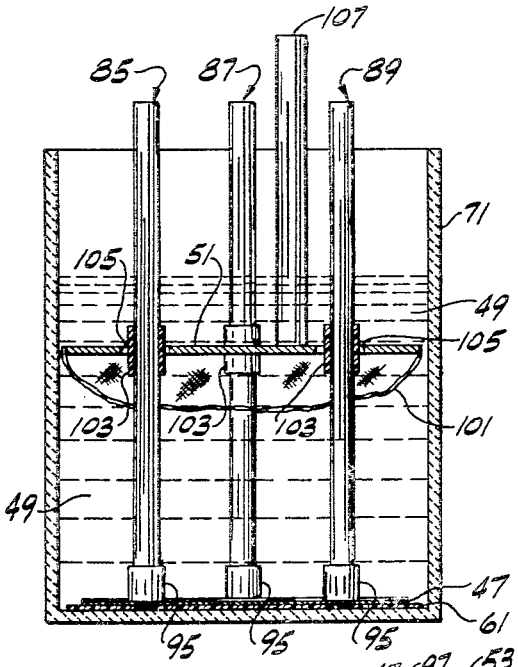
FIG. 8 is an enlarged sectional view of part of the apparatus shown in FIG. 7.

Nickel anode 51 is shown in an intermediate position in FIGS. 7 and 8 for purposes of clarity. During electrodeposition, it rests on PVC spacers 95 and is thereby kept at an exact spacing from plate 47. Polypropylene tubes 103 suround rods 83, 85, 87 and 89 to prevent shoring between the rods and anode 51. Although shown in positions intermediate rods 83, 85, 87 and 89 in FIGS. 7 and 8 to illustrate their function, tubes 103 actually rest on spacers 95 during electrodeposition. To ensure that tubes 103 prevent shoring between anode 51 and rods 83, 85, 87 and 89, it is preferred that tubes 103 fits snugly on the rods and extend from spacers 95 to near the top of the rods.

A fifth titanium rod, 107, is connected to anode 51 to provide electrical connection between the anode and constant-current power supply 109. Rod 107 is also covered with a polypropylene tube (not shown). A wire 111 interconnects the anode terminal of power supply 109 and titanium rod 107. Likewise a wire 113 interconnects the cathode terminal of power supply 109 and titanium rods 83, 85, 87 and 89.

Before starting electrodeposition, it is necessary to stir electrolyte 49 in order to suspend the diamond particles (and alumina particles, if any) in the electrolyte. It is desirable to allow the suspension to settle for about 2.5 minutes after stirring before beginning electrodeposition of the nickel. This settling allows a thin blanket of diamond powder (and alumina, etc.) to form on the exposed portions of plate 47 corresponding to annular patterns 53, 55, 57 and 59. Once electrodeposition starts these diamond particles, along with others which settle out of solution during electrodeposition of the nickel, are bonded into nickel matrix 7 as it forms around them. Even during electrodeposition of the nickel, the diamond particles continue to settle to aluminum substrate 47 more rapidly than they are codeposited into the matrix.

After the diamond powder in electrolyte 49 has been allowed to settle for the predetermined settling time, in this case about 2.5 minutes, constant-current power supply 109 is turned on. It is important that a constant-current power supply be used. Otherwise as electrodeposition or plating of the nickel on plate 47 progresses, the current will rise, damaging the blades. Current from power supply 109, i.e., the current of electrodeposition, is held to no greater than about 20 amps per square foot (215 amps/sq. m) of the annular pattern. If 2-3/16" (5.5 cm) blades are being produced, the size of annular patterns 53, 55, 57 and 59 is such that the maximum desirable current supplied by power supply 109 is held to around 1 amp. All following discussion will assume that four 2-3/16" (5.5 cm) blades are being made. Currents greater than one amp result in bubbles being formed on the blades, which renders the blade useless. It is preferable, in fact, to limit the current to 600–800 milliamps, when making blades of this size, to prevent bubble formation. The lower this current, however, the longer it takes to make a blade of any given thickness. Plating rate is, of course, also a function of temperature. The lower the temperature of electrolyte 49, the slower the plating rate.

It has been found to be desirable to precede electrodeposition at a current of from 600 milliamps to one amp by five minutes of electrodeposition at a current around 200 milliamps, i.e., around four amps per square foot (43 amps/sq. m) of the annular pattern. Of course, the electrodeposition could continue at this current until the desired blade thickness is reached, but it would take too long. After the five minutes of low-current deposition, power supply 109 is typically set up to 800 milliamps. At that current it would take around 40 more minutes to make a one-mil blade. At 600 milliamps it would take ten minutes longer than that.

In order to obtain the desired concentration of diamond particles (or diamond and alumina particles) in blade 1, it is important that electrolyte 49 not be agitated during electrodeposition of the nickel. The diamond particles are thus allowed to deposit on the exposed annular portions of substrate 47 while the nickel plates on said exposed portions.

Once the desired thickness of nickel and diamond has been plated onto exposed portions of plate 47 corresponding to annular patterns 53, 55, 57 and 59, power supply 109 is disconnected from titanium rods 83, 85, 87, 89 and 107. Plate 47 should then be swirled slightly while still in electrolyte 49 to remove excess, unplated diamonds from its surface. Aluminum plate 47 is then removed from glass beaker 71, washed and disconnected from its titanium rods. With an aluminum plate 47 around 0.008" (0.02 cm) thick, blade 1 is stripped from plate 47 by bending the plate away from the annular deposit which forms blade 1, as shown at 115, while grasping blade 1 and peeling it the rest of the way off plate 47. Care is exercised in stripping blade 1 off plate 47. Although blade 1 is flexible, if not handled carefully it will tear. If plate 47 is too thick to bend, blade 1 is etched off the plate, but this damages the blade somewhat.

It is advantageous to lightly abrade blade 1 while it is still on plate 47 with a crocus cloth or No. 600 wet or dry silicon sandpaper, preferably the latter. During electrodeposition, impurities, such as carbon from anode 51, fall upon the surface of what is to become blade 1. Nodules, composed mainly of nickel, form around these impurities, especially at higher current densities, forming an irregular surface on blade 1, as shown in exaggerated fashion in FIG. 11. Loose diamond particles 117 also contribute to the irregularity of the surface. Also, the edges 119 of blade 1 tend to be slightly higher than the surface of the blade between the edges. Abrading as described above removes the nodules, the loose diamond particles 117 and the build-up on edges 119, thus making a smoother, narrower-cutting blade.

After being removed from plate 47, blade 1 is ready to be mounted in mounting means 11 or 11A and used.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An extremely thin flexible, self-supporting cutting blade of a predetermined disc-shaped form having a thickness in the range of about 0.0006 inch to about 0.006 inch or more, the blade having fully exposed opposed lateral sizes and a fully exposed peripheral cutting portion for dicing or sawing electronic crystal substrates, or the like, the blade throughout its thickness extending between the lateral sides thereof comprising a metal matrix and diamond particle cutting elements disposed substantially throughout the matrix, the inner portion of each of the exposed sides of the blade being adapted to be engaged by mounting means in order that the outer peripheral cutting portion remains exposed for cutting upon engagement of the blade by the mounting means, the blade being made by electrodeposition of a matrix of metal as an extremely thin layer of metal in the predetermined disc-shaped form upon a surface of a flat, electrically conductive substrate immersed in a suspension having the diamond particle cutting elements dispersed within an electrolyte, the diamond particle cutting elements being codeposited in the matrix of metal during electrodeposition thereof, the matrix being separated from the substrate after formation of the metal matrix with the diamond particle cutting elements disposed therein, thereby providing the extremely thin flexible self-supporting cutting blade.

2. A blade as set forth in claim 1, wherein the metal matrix is a nickel matrix.

3. A blade as set forth in claim 2 wherein the volume of the nickel matrix is no greater than about 55% of the total volume of the blade.

4. A blade as set forth in claim 3 wherein the diamond particles are substantially homogeneously dispersed throughout the blade.

5. A blade as set forth in claim 3 wherein the size of the diamond particles disposed in the nickel matrix is substantially between about six and about eight microns, 6. A blade as set forth in claim 3 and including additional particles disposed in the nickel matrix having a specific gravity substantially that of the diamond particles.

7. A blade as set forth in claim 6 wherein the additional particles in the matrix are alumina particles, the alumina particles being in said suspension and being codeposited along with the diamond particles in the nickel matrix.

8. A blade as set forth in claim 7 wherein the volume of the nickel matrix excluding the diamond and alumina particles is no greater than about 55% of the volume of the blade.

9. A blade as set forth in claim 7 wherein the size of the alumina particles disposed in the matrix is substantially between about six and about nine microns and the size of the diamond particles disposed in the matrix is substantially between about six and about eight microns.

10. A blade as set forth in claim 7 wherein the percentage of alumina particles in the blade by weight is approximately equal to the percentage of diamond particles in the blade by weight.

11. A blade as set forth in claim 7 wherein the percentage of alumina particles in the blade by weight is less than the percentage of diamond particles in the blade by weight.

12. A blade as set forth in claim 2, wherein the nickel is electrodeposited in an annular pattern corresponding to the predetermined form of the blade on said surface of said substrate.

13. A blade as recited in claim 1, wherein the matrix consists essentially of nickel.

14. A blade as recited in claim 2, wherein said electrodeposited nickel is only lighly adherent to said substrate surface.

15. A blade as set forth in claim 1, wherein the substrate is aluminum.

16. A blade as set forth in claim 1, wherein the substrate is flexible and the matrix is separated from the substrate by flexing the substrate relative to the matrix and stripping the matrix from the substrate.

17. A blade as set forth in claim 12, wherein the substrate has an exposed portion in the shape of said annular pattern and the nickel is electrodeposited on said exposed portion of the substrate.

18. A blade as set forth in claim 17, wherein the substrate is photoresistively masked to form the predetermined exposed portion.

* * * * *

REEXAMINATION CERTIFICATE (20th)

United States Patent [19]

Runyon

[11] B1 4,219,004

[45] Certificate Issued Sep. 28, 1982

[54] FLEXIBLE, SELF-SUPPORTING BLADE FOR CUTTING ELECTRONIC CRYSTALS AND SUBSTRATES OR THE LIKE

[75] Inventor: Robert C. Runyon, St. Louis County, Mo.

[73] Assignee: Chemet Research, Inc., Fenton, Mo.

Reexamination Request

No. 90/000,105, Nov. 10, 1981

Reexamination Certificate for:

| | |
|---|---|
| Patent No.: | **4,219,004** |
| Issued: | **Aug. 26, 1980** |
| Appl. No.: | **961,946** |
| Filed: | **Nov. 20, 1978** |

Related U.S. Application Data

[62] [Division] *Continuation* of Ser. No. 825,587, Aug. 18, 1977, abandoned.

[51] Int. Cl.[3] ..... B28D 1/04; B05D 3/02

[52] U.S. Cl. ..... 125/15; 427/383.7

[58] Field of Search ..... 125/15; 51/206 R; 427/383.7

[56] References Cited

FOREIGN PATENT DOCUMENTS 46-77 1/1971 Japan.

*Primary Examiner*—Harold D. Whitehead

*Attorney, Agent, or Firm*—Kenyon & Kenyon

[57] ABSTRACT

A diamond-nickel blade for cutting electronic crystals and substrates or the like comprising diamond particles in a nickel matrix. The nickel matrix is the sole support for the blade and the volume of the nickel matrix is no greater than about 55% of the volume of the blade. Such blades are made by immersing a flat, electrically conductive substrate in a suspension comprising diamond particles in an electrolyte; electrodepositing nickel in an annular pattern corresponding to the desired shape of the blade on a surface of the substrate, the electrodeposited nickel being only lightly adherent to the substrate surface (diamond particles are thereby codeposited in the nickel which forms a matrix around them); and stripping the annular deposit of nickel and diamond particles from the substrate. Also disclosed are blade-mounting means comprising two identical, lapped-surface collars and a ring.

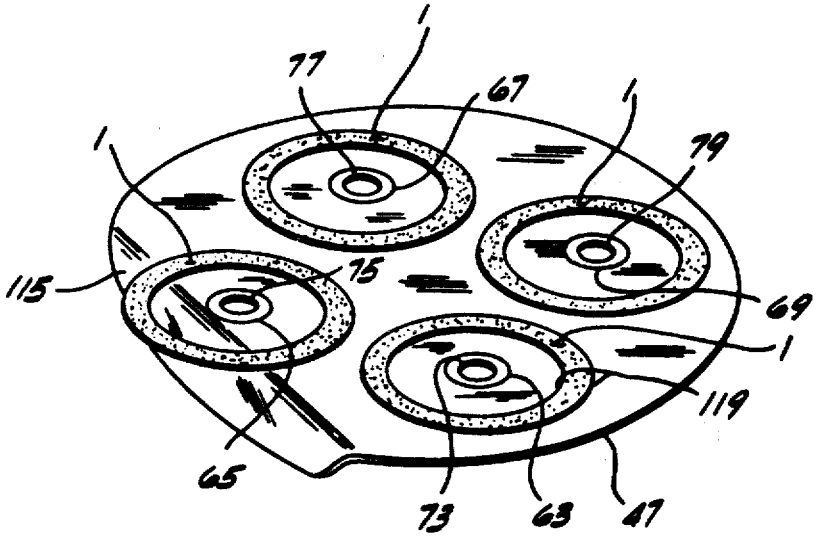

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, paragraph 1:

This is a [division] *continuation* of application Ser. No. 825,587 filed Aug. 18, 1977 and now abandoned.

AS A RESULT OF REEXAMINATION, IT HAS BEEN DETERMINED THAT:

The patentability of claims 2–18 is confirmed.

Claim 1 is determined to be patentable as amended:

1. An extremely thin, flexible, [self-supporting] *free-standing* cutting blade *having* [of] a predetermined *annular,* disc-shaped form [having] *and* a thickness in the range of about 0.0006 inch to about 0.006 inch or more, the blade having fully exposed opposed lateral [sizes] *sides* and a fully exposed peripheral *portion, the outer portion of each lateral side and the peripheral portion forming a* cutting portion for dicing or sawing electronic crystal substrates, or the like, the blade throughout its *entirety* [thickness extending between the lateral sides thereof] comprising a metal matrix and diamond particle cutting elements disposed substantially throughout the matrix, *a portion of a substantial number of the diamond particle cutting elements being exposed throughout each lateral side of the blade,* [the inner portion of each of the exposed sides of] the blade being adapted to be engaged by mounting means *which are independent of the blade such* [in order] that the [outer peripheral] cutting portion remains exposed for *dicing or sawing* [cutting upon engagement of the blade by the mounting means], the blade being made by electrodeposition of a matrix of metal as an extemely thin layer of metal in the predetermined *annular,* disc-shaped form upon a surface of a flat, electrically conductive substrate immersed in a suspension having the diamond particle cutting elements dispersed within an electrolyte, the diamond particle cutting elements being codeposited in the matrix of metal during electrodeposition thereof *to an extent that the portion of the substantial number of diamond particle cutting elements are exposed throughout each lateral side of the blade,* the matrix *of metal and codeposited diamond particle cutting elements in the annular, disc-shaped form with the portion of the substantial number of diamond particle cutting elements exposed throughout each lateral side of the blade* being separated from the substrate [after formation of the metal matrix with the diamond particle cutting elements disposed therein], thereby providing the extremely thin, flexible [self-supporting], *free-standing* cutting blade *with the portion of the substantial number of diamond particle cutting elements exposed throughout each lateral side of the blade.*

* * * * *